US005419469A

United States Patent [19]

Urso

[11] Patent Number: 5,419,469

[45] Date of Patent: May 30, 1995

[54] PORTABLE GARMENT FINISHING MACHINE

[76] Inventor: Charles L. Urso, 54 Marivista Ave., P.O. Box 1136, Waltham, Mass. 02254

[21] Appl. No.: 32,611

[22] Filed: Mar. 17, 1993

[51] Int. Cl.[6] ..... A41H 5/00; A41H 43/00

[52] U.S. Cl. ..... 223/70; 223/51; 223/52; 223/57

[58] Field of Search ..... 223/70, 73, 76, 51, 223/52, 57, 120; 38/12, 14, 13

[56] References Cited

U.S. PATENT DOCUMENTS

| | | | |
|---|---|---|---|
| 2,443,557 | 6/1948 | Fitpold . | |
| 2,735,595 | 2/1956 | Glover, Jr. . | |
| 2,967,006 | 1/1961 | Sykes | 223/120 |
| 3,208,652 | 9/1965 | Zimmerman | 223/73 |
| 3,216,633 | 11/1965 | Paris . | |
| 3,603,490 | 9/1971 | Killey | 223/70 |
| 3,715,064 | 2/1973 | North et al. | 223/70 |
| 3,727,811 | 4/1973 | Buckley . | |
| 3,892,047 | 7/1975 | Miller-Scherak | 223/70 |
| 4,063,376 | 12/1977 | Horiuchi | 223/73 |
| 4,199,088 | 4/1980 | Sanko . | |
| 4,419,302 | 12/1983 | Nishino et al. | 261/242 |
| 4,437,246 | 3/1984 | Sanko | 223/73 |
| 4,728,015 | 3/1988 | Holzapfel et al. | 223/70 |

*Primary Examiner*—Clifford D. Crowder
*Assistant Examiner*—Bibhu Mohanty

[57] ABSTRACT

A portable garment finishing machine (30) includes a hollow gripper (102) for gripping an edge portion of a suspended garment such that the gripper closes the edge portion upon itself in a spread condition. Treating fluid forced through the hollow gripper treats the gripper clamped garment portion while a longitudinally extendible conduit (32) conducts treating fluid interiorly of the garment. One of several embodiments of a fluid distributor (31, 316, 600), connected to the conduit, vertically traverses the garment interiorly and directs the fluid at interior garment surfaces. The treating fluid includes steam produced by vaporizing a water mist generated by ultrasonic means (450). A shoulder-shaped form (330) is provided to serve several functions including prevention of fluid escape through garment neck openings. The form is upwardly openable for receiving a garment hanger (344) such that the form can close over the hanger to avoid fluid loss. Lifting the hanger from the form simultaneously lifts the garment off the form thereby hanging the garment on the hanger. A detachable lapel clamp (800) is included with the form. A diverter (702) optionally connects a tumble dryer (700) to the finishing machine which reuses dryer exhaust as treating fluid. The diverter includes a disposable filter bag (704) to filter the exhaust and a blower (746) to vent overhumidified or overheated ambient air from the laundry area. Feedback control means are included in the system to control temperature and relative humidity of the treating fluid and of ambient air in the laundry area.

19 Claims, 11 Drawing Sheets

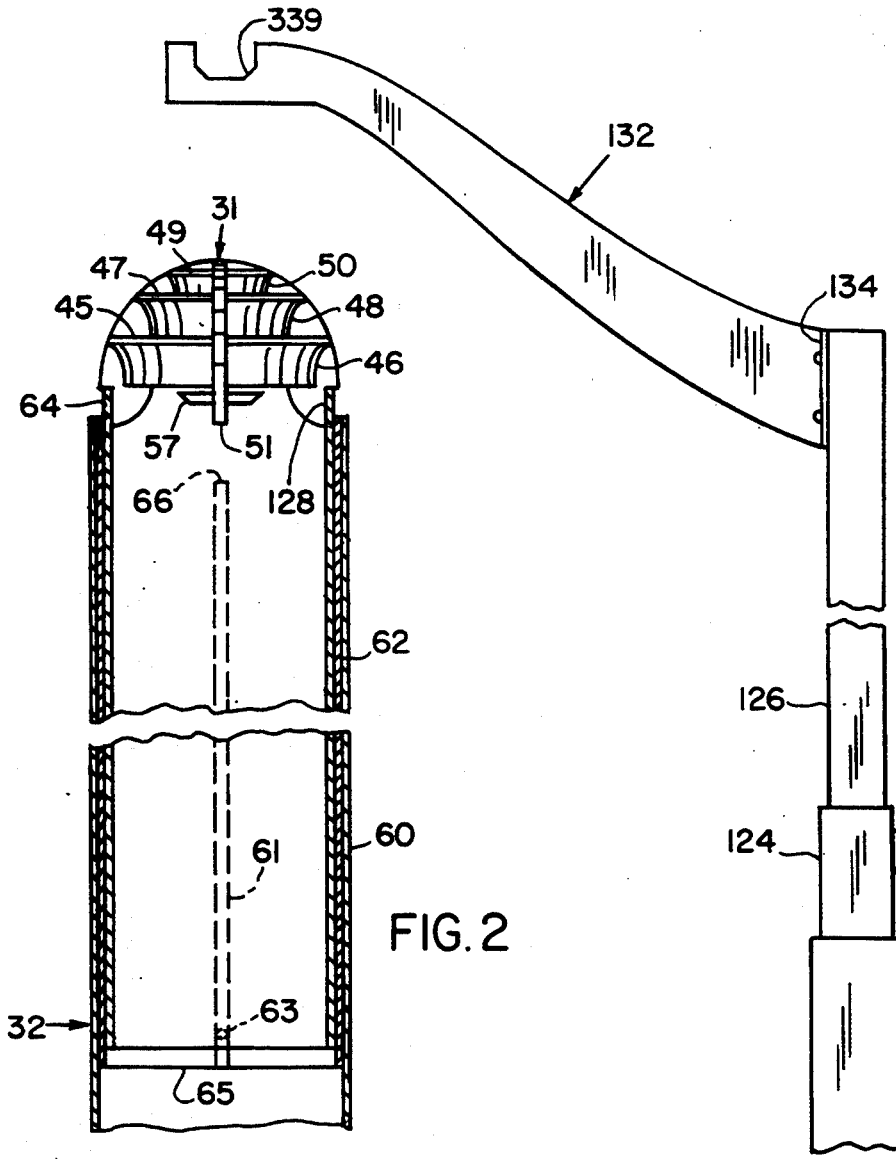
FIG. 2
FIG. 6
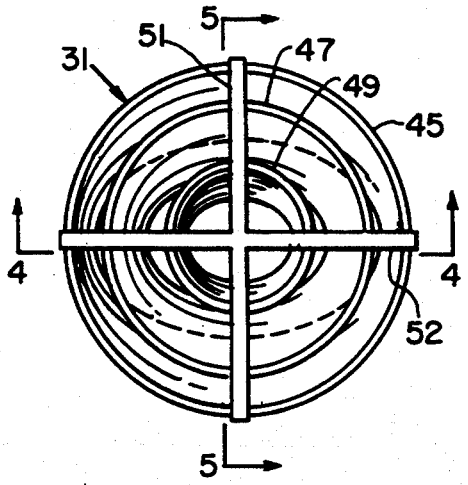
FIG. 3
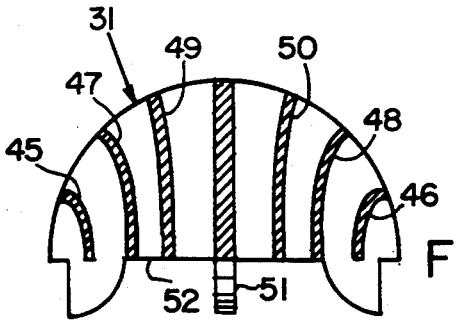
FIG. 4
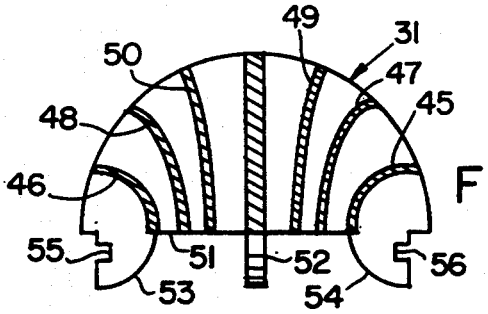
FIG. 5

PORTABLE GARMENT FINISHING MACHINE

TECHNICAL FIELD

This invention relates to wrinkle-removing machines that operate by introducing treating fluid under pressure, such as steam and/or hot air, within a garment and more particularly to a machine which distributes the fluid by a distributor which is movable within the garment.

BACKGROUND

Commercial methods of unwrinkling clothes include draping a garment over a permeable bag in which hot air and steam are emitted under pressure. The fluid distends the bag against the garment wherein the fluid flows therethrough to treat the garment. Relatively large sources of steam and forced air are required by the method. Specialized machines are also in professional use for particular types of garments or portions of garments. A shirt, for example, might require one machine for treating the main body, another machine for treating the sleeves and still another for treating the cuffs and collar. Commercial pressing and finishing machines work well in a high-volume plant system, but are not practical for home use.

In a house, apartment, or hotel room, the present invention provides a bagless finishing machine which closes garment openings and forces treating fluid directly through distended garment surfaces. Any type of outer garment, wet or dry, can be mounted on the device to be dried wrinkle-free or just unwrinkled if already dry. An external steam source is not necessary.

Other advantages of the invention will become apparent from consideration of the drawings and ensuing description.

BRIEF DESCRIPTION OF THE DRAWINGS

The accompanying drawings in combination with the description herewith, illustrate features and advantages of the invention. Like reference numerals in different views refer to the same parts. The drawings are intended to illustrate principles of the invention and are not necessarily to scale and in which drawings:

FIG. 2 is a fragmental side view in elevation, partly in section, of the machine of FIG. 1;

FIG. 3 is a top view of a general use fluid distributor;

FIG. 4 is a sectional view taken vertically along the line 4—4 of FIG. 3;

FIG. 5 is a sectional view taken vertically along the line 5—5 of FIG. 3;

FIG. 6 is a fragmental side view in elevation of a longitudinally extendible pole and garment support arm for supporting a garment during treatment;

DETAILED DESCRIPTION

Figure 1:
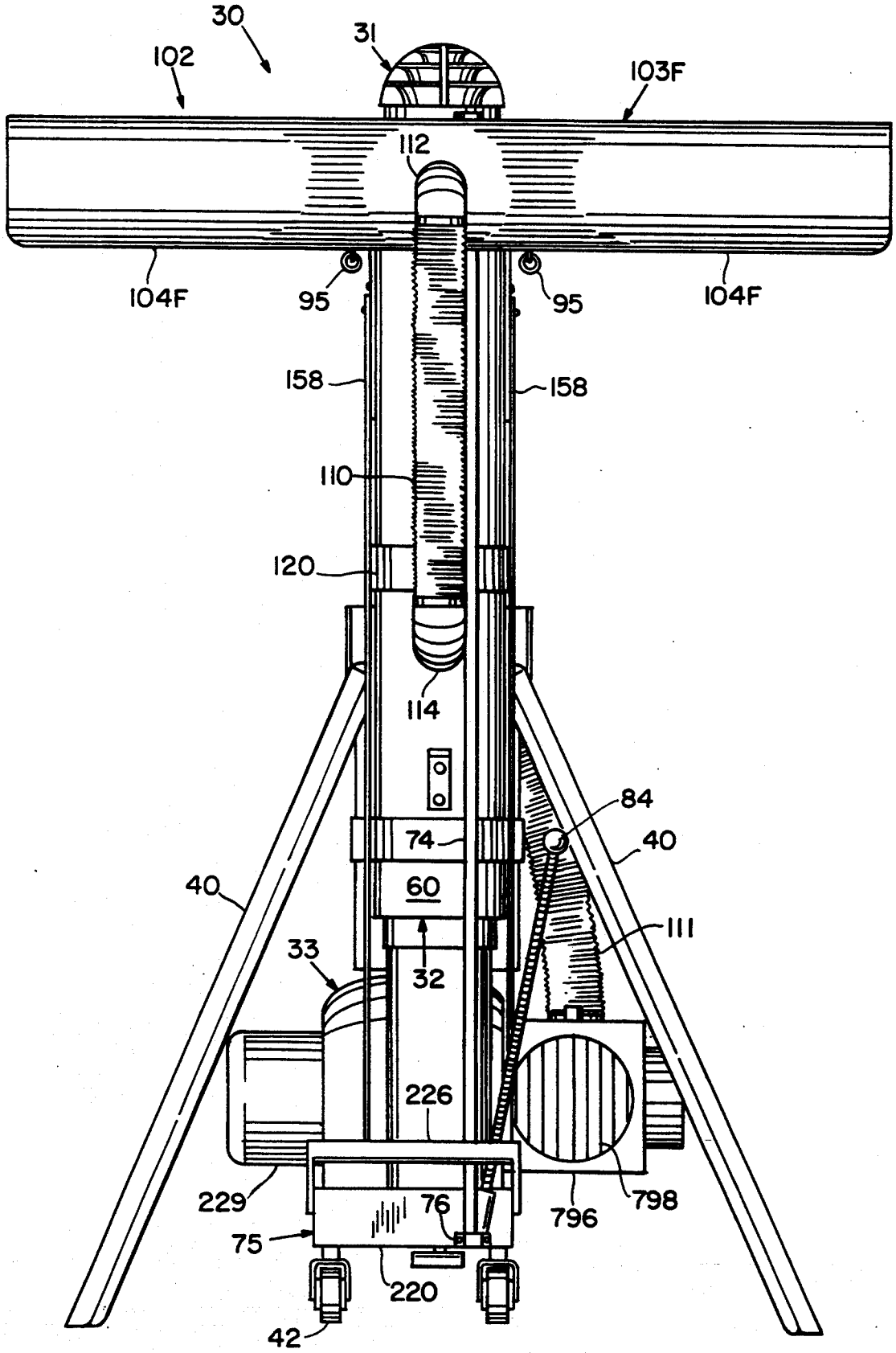
FIG. 1 is a front elevational view of a garment finishing machine constructed in accordance with the invention, some parts being removed.

A device embodying principles of the present invention is identified generally by numeral 30 in FIG. 1. Details are explained after a brief introductory outline of the general arrangement of major components.

The device includes a vertically supported longitudinally extendible fluid conducting means or conduit 32. An upper end portion of the conduit, combined with a fluid distributor 31, comprises a fluid emitting means. Connected in fluid communication with the conduit is a treating fluid source or heat blower 33. The distributor directs the fluid, under pressure, at inside surfaces of a garment (FIGS. 18 and 19) surrounding the distributor. Control means, including a handle 84 shown in FIG. 1, is provided for vertically moving the distributor to traverse the interior of the garment.

Garment holding means comprising a garment gripper 102 for holding an edge portion of a garment, is positioned about an upper end portion of a stationary section 60 of the conduit. The gripper 102 is provided with garment spreading arms, including arms 104F.

Pivotally mounted legs 40 provide added stability for the device during operation. Swivel mounted wheels 42 provide mobility.

Details of the general use fluid distributor 31 are shown in FIGS. 1–5. In an operating position, the distributor has an axis in common with the conduit longitudinal axis. Included is a first fluid guide 45 surrounding the axis in spaced relation and having a funnel-shaped outer surface 46 extending laterally of the axis for diverting fluid laterally. Surface 46 includes a lower perimeter edge portion defining an approximately elliptical configuration and an upper perimeter edge portion defining an approximately circular configuration. The surface 46 is symmetrical on opposite sides of a dividing plane in which the axis lies, which plane is envisioned in FIG. 3 as being perpendicular to the page and parallel to the line 4—4.

Fluid distributor 31 further comprises a second fluid guide 47 surrounding the axis in spaced relation and having a funnel-shaped outer surface 48 extending upward relative to the first guide surface for distributing fluid laterally, but at a higher angle than the first guide. Surface 48 includes a lower perimeter edge portion defining an approximately elliptical configuration and an upper perimeter edge portion defining an approximately circular configuration. The surface 48 is symmetrical on opposite sides of the mentioned dividing plane. Second guide 47 is positioned within first guide 45 in spaced relation.

The distributor 31 further comprises a third fluid guide 49 surrounding the distributor axis in spaced relation and having a funnel-shaped outer surface 50 extending upward relative to the second guide surface for distributing fluid laterally, but at a higher angle than the second guide. Surface 50 includes a lower perimeter edge portion defining an approximately elliptical configuration and an upper perimeter edge portion defining an approximately circular configuration. The surface 50 is symmetrical on opposite sides of the mentioned dividing plane. Third guide 49 is positioned within second guide 47 in spaced relation. The shortest diameters of the respective ellipses of the three guides are aligned with each other.

The three guides of the distributor are molded to two vertical semi-circular plates 51, 52 joined perpendicular to each other along the axis. Downward extending portions of plate 51 form lugs 53, 54 (FIG. 5) having notches 55, 56, respectively. The notches receive horizontal projections 57 (FIG. 2) extending inward from an inner surface of an upper portion of a conduit section 64. Hence, by inserting and twisting the distributor 31 into the conduit section 64, the distributor is secured. Conversely, by twisting in reverse and pulling upward, the distributor can be removed from the conduit.

When the distributor is secured in the conduit, the mentioned dividing plane is perpendicular to the deployed gripper arms. The conduit upper end portion has a circular inner fluid guiding surface 128 surrounding the axis and being in spaced relation to the axis and to the distributor first guide surface. During operation, fluid passes through the distributor and emits from between the guide surfaces. Fluid, passing between the first guide surface and the inner surface of the conduit, emits therefrom such that the emitted fluid concentration in ambient air equalizes in a pattern which horizontally is approximately elliptical.

Figure 7:
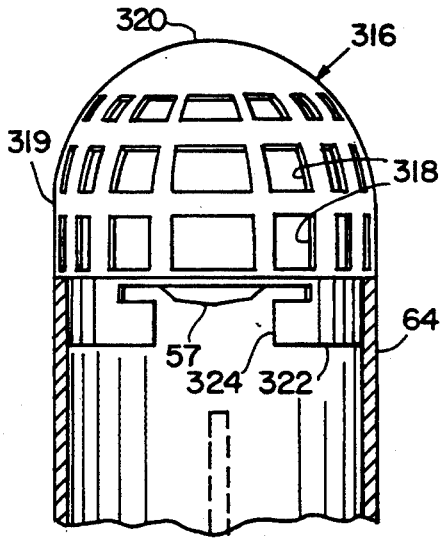
FIG. 7 is an elevational view of a second general use fluid distributor mounted on a top end portion of a conduit, the second distributor being an alternative component.

FIG. 7 shows a second-general use fluid distributor 316; an accessory which is an alternative to distributor 31. General distributor 316, in an operating position, includes an axis in common with the conduit longitudinal axis and a dome-shaped wall 319 surrounding the axis in spaced relation. The wall having openings 318 distributed around the axis for emitting fluid. The openings being symmetrical on opposite sides of a dividing plane in which the axis lies, which plane is envisioned as the surface on which FIG. 7 is drawn. Generally each of the openings being greater in area relative to the area of an adjacent opening which is closer to the plane. Generally each area of the wall between two openings is smaller relative to an adjacent area of the wall between two openings which adjacent area is closer to the plane.

An annular central deflector 320, positioned above the openings and having an concave undersurface, directs fluid through the openings.

The second distributor lower end portion is formed into a cylinder 322 which is received into conduit portion 64. T-shaped slots 324 are cut into diametrically opposite sides of cylinder 322 to receive projections 57 when the distributor is inserted and twisted in the conduit, thereby locking the distributor and conduit together.

In the locked position the largest openings of distributor 316 are aligned in the directions of the deployed gripper arms. Like distributor 31, distributor 316 emits fluid such that the emitted fluid concentration in ambient air equalizes in a pattern which horizontally is approximately elliptical. The pattern approximates the horizontal cross-sectional shape of a gripper held inflated garment for an even treatment.

Figure 8:
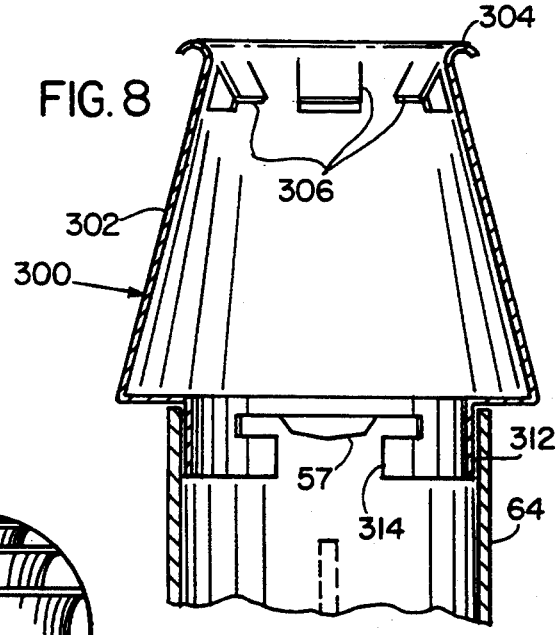
FIG. 8 is a vertical sectional view of a sleeve distributor mounted on a top end portion of the conduit, the sleeve distributor being an accessory component.
Figure 20:
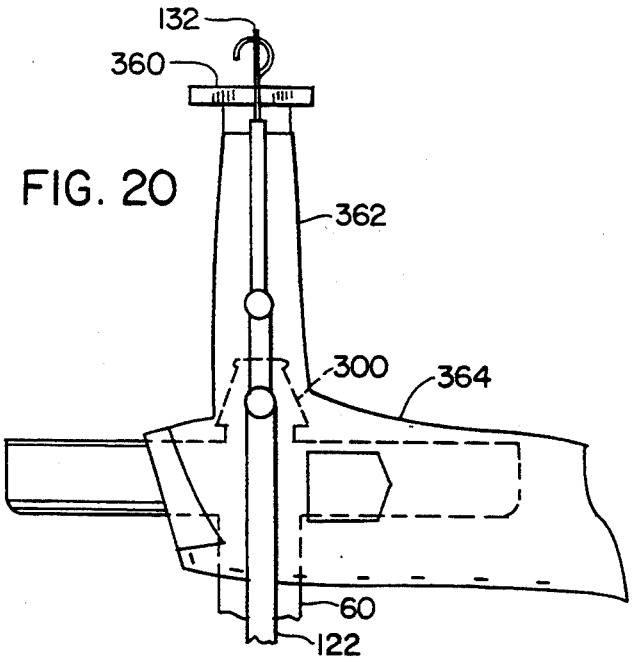
FIG. 20 is a fragmental back elevational view of the finishing machine, a shirt sleeve hangs from the garment support arm of the extendible pole wherein the sleeve distributor, mounted on the conduit, is inserted in a lower portion of the sleeve.

FIGS. 8 and 20 show a sleeve treating distributor 300; an accessory for treating narrow tubular garment portions, such as shirt sleeves and childrens trouser legs. The sleeve distributor in an operating position includes an enclosure 302 having a vertical axis in common with the conduit axis. The enclosure having a lower end portion defining an annular opening for fluid from the conduit to pass into the enclosure and an opposite or upper end portion defining an annular opening for fluid to pass upward out of the enclosure. Enclosure 302 is tapered narrowing toward the upper end portion for being easily received by a narrow tubular garment portion, such as a sleeve as shown in FIG. 20, to surround the enclosure.

A deflector 304 (FIG. 8), positioned adjacent the upper end portion, includes a surface surrounding the axis in spaced relation. The surface faces laterally and downward for deflecting fluid from within the enclosure to flow over the exterior of the same. The deflected fluid treats the garment portion surrounding the enclosure. The deflecting surface of deflector 304 includes the underside of flaps 306 positioned in the path of upwardly moving fluid. The flaps are formed by cutting and bending portions of the enclosure wall. Most fluid passing through the distributor bypasses the deflector to treat the rest of the garment portion.

The sleeve distributor lower end portion is formed into a cylinder 312 which is received into conduit portion 64. T-shaped slots 314 are cut into diametrically opposite sides of cylinder 312 to receive projections 57 when the sleeve distributor is inserted and twisted in conduit portion 64. Hence, the distributor and conduit are locked together. Conversely, by reverse twisting and pulling upward, the distributor 300 can be removed from the conduit.

As best seen in FIG. 2, upper conduit section 64 is slidably supported within a middle conduit section 62 which is slidably supported in stationary conduit section 60. Extending outward from an outer surface of a lower end portion of section 64 is a projection 63. The projection 63 is received in a vertical groove 61 inside the wall of middle conduit section 62. The depth of groove 61 is shallow so as not to penetrate through the wall of section 62. Groove 61 extends from the lower end 65 of section 62 and along most of its length, but ends at a stop location 66 short of reaching the upper end. When conduit section 64 is compelled to slide upward within section 62, projection 63 is guided within groove 61 until reaching the end of the groove at stop location 66. Further upward movement of section 64 pulls middle section 62 upward within stationary section 60.

Figure 10:
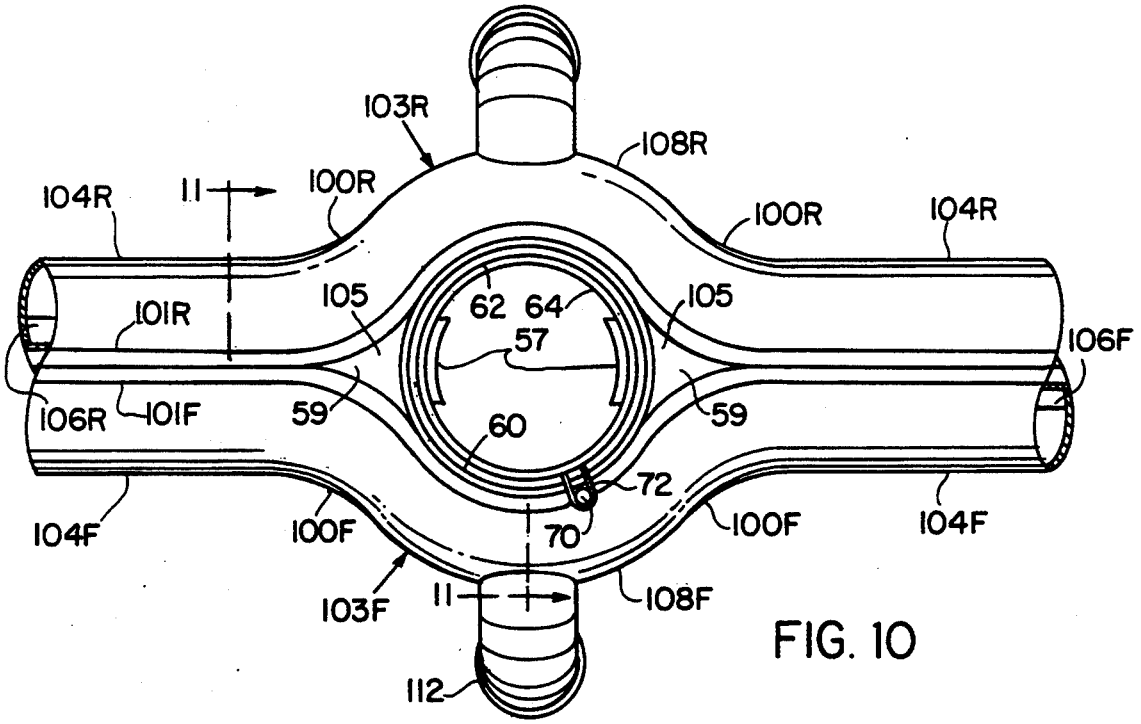
FIG. 10 is a fragmental top view of the gripper and conduit of FIG. 9.
Figure 12:
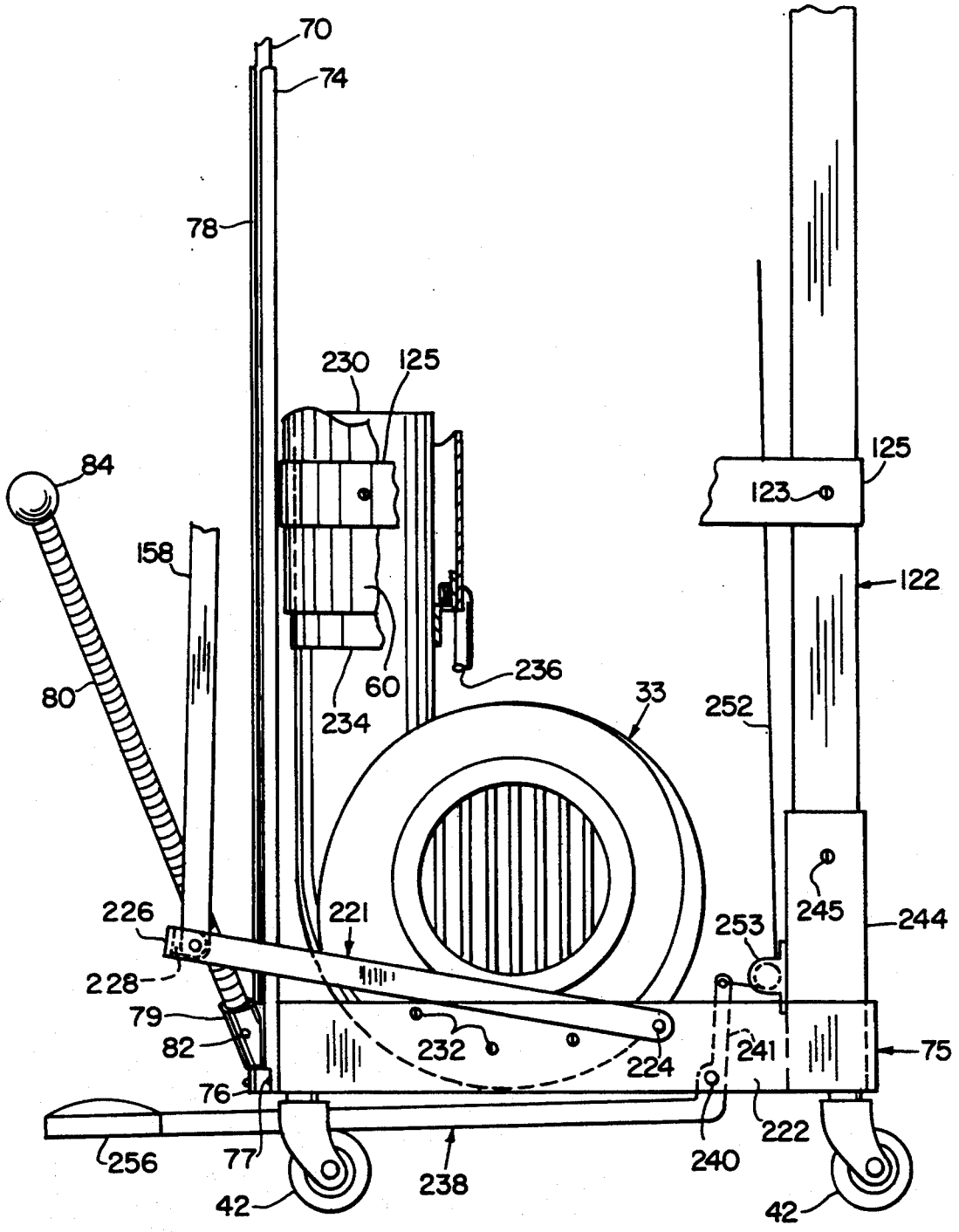
FIG. 12 is a fragmental side view in elevation of a lower portion of the finishing machine.

The fluid emitting means, including one of the distributors, is moved by control means which includes a rod 70 (FIGS. 10 and 12). An upper end portion of rod 70 is fixedly connected to an upper end portion of conduit section 64 by a U-shaped bracket 72 riveted to the conduit section and rod.

Rod 70 is slidably supported within a vertically positioned sleeve 74 (FIGS. 1 and 12). Sleeve 74 has a lower end portion fixed to the base 75 by a U-shaped bracket 76 tightly surrounding the sleeve. Rivets 77 (FIG. 12) fasten the bracket to the base. Sleeve 74 includes a longitudinal slot 78 which runs the entire length of the sleeve.

An angled sleeve-like holder 79 (FIG. 12) includes a narrow lug slidably received in the slot 78 wherein the lug is welded to a lower end portion of rod 70. An angled aperture in holder 79 receives a lower end portion of a flexible shaft 80 which is fixed to the holder by a screw 82.

A spherical handle 84 includes a threaded aperture which threadedly receives an upper end portion of shaft 80 therein. Since holder 79 is vertically slidable along the length of sleeve slot 78, a user can telescopically extend and retract the conduit by vertically moving handle 84 up and down. Hence, the handle 84 vertically moves the distributor to which the rod 70 is indirectly connected.

Another method (not shown) of extending and retracting the conduit could be achieved by connecting a cord (not shown) to the holder 79 and passing the cord through a pulley (not shown) attached to an upper end portion of conduit section 60. Pulling on the cord would extend the telescoping conduit and releasing the cord would retract the conduit.

A support band 125 (FIG. 12) surrounds conduit section 60. Two end portions of the band are mounted on opposite sides of a pole 122 which has a square cross-section. Screws, including screw 123, fix the band to the pole.

A similar support band 120 (FIG. 1) also ties the conduit, and pole together so that bands provide lateral support.

As shown in FIG. 6, pole 122 includes telescoping sections 124, 126 which can be vertically adjusted and held in selected positions by screws having respective handles 130.

A garment support arm 132 includes a lower end having a flange 134 which is riveted to an upper end portion of pole section 126. Arm 132 includes a hook-receiving notch 339 normally positioned along the conduit axis above the distributor.

Figure 9:
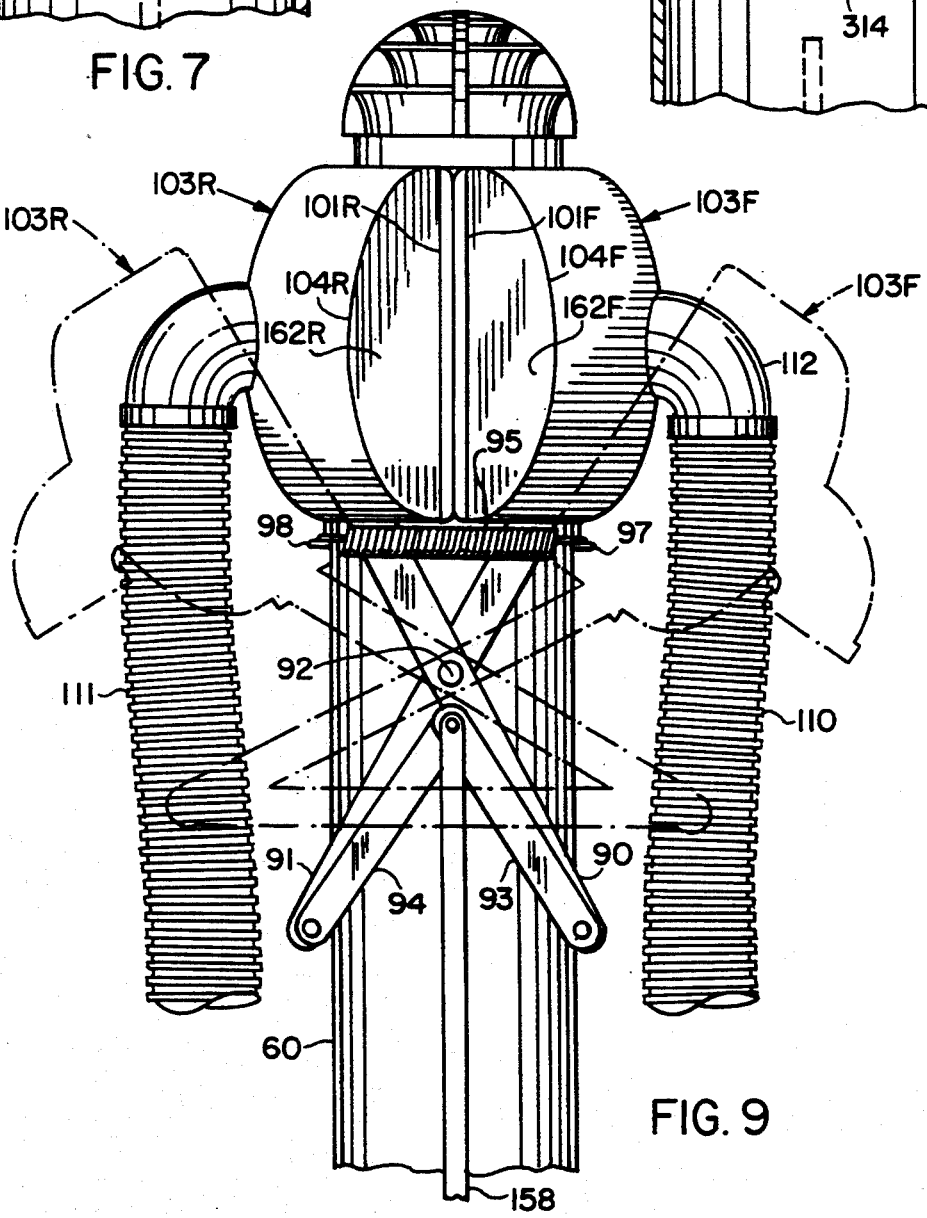
FIG. 9 is a fragmental side view in elevation of the finishing machine of FIG. 1 including a garment gripper mounted about the longitudinally extendible conduit.
Figure 11:
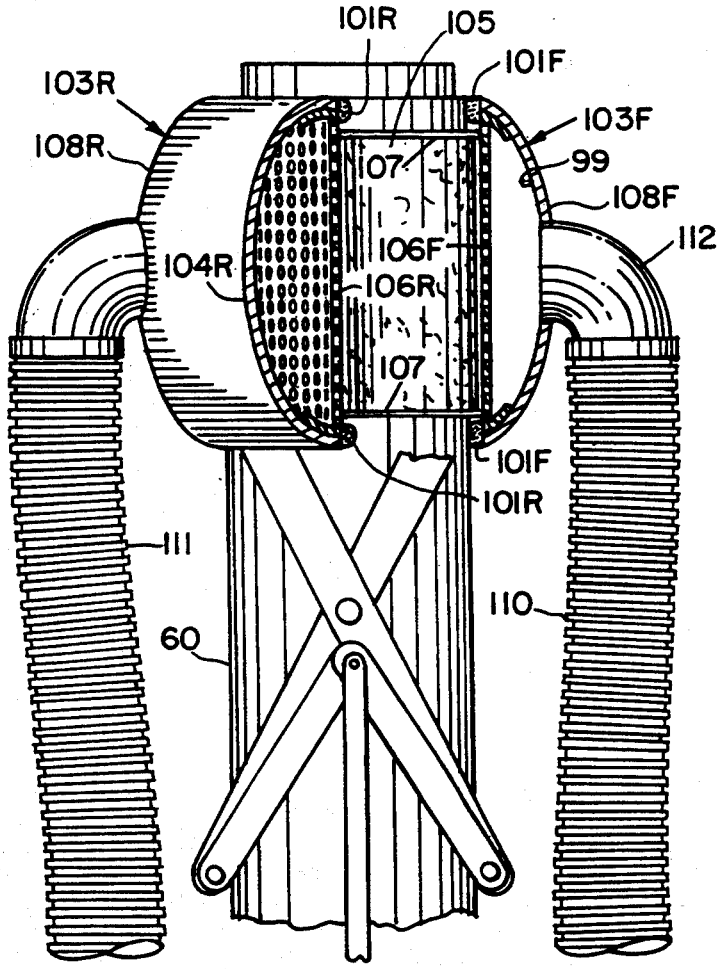
FIG. 11 is a fragmental side view in elevation, partly in section taken vertically along the line 11—11 of FIG. 10.

The garment gripper 102 is shown in detail in FIGS. 9–11. The gripper includes opposed front and rear clamps 103F and 103R, respectively, positioned such that the conduit is between the clamps. Each clamp is constructed similar to the other clamp and each clamp is movably supported and movable between a gripping position, for gripping a garment, and an open position.

The clamps 103F, 103R have two similar sets of support means symmetrically arranged on opposite sides of conduit section 60. FIG. 9 shows the details of one set wherein the clamps are supported on upper end portions of crossed upper levers 90 and 91. The levers are pivotally supported on an axle 92 which is welded to conduit section 60. Lower end portions of the levers are pivotally connected to end portions of respective lower levers 93, 94. Opposite end portions of the lower levers are pivotally connected to the upper end portion of a connecting rod 158. It can be understood that when rod 158 is pulled down, clamps 103F, 103R will move to an open position as indicated by the phantom image of FIG. 9. When rod 158 moves up, the clamps close. The clamps are urged to close to the gripping position by springs 95 connected to hooks 97, 98 fixed to respective opposing clamps.

Figure 18:
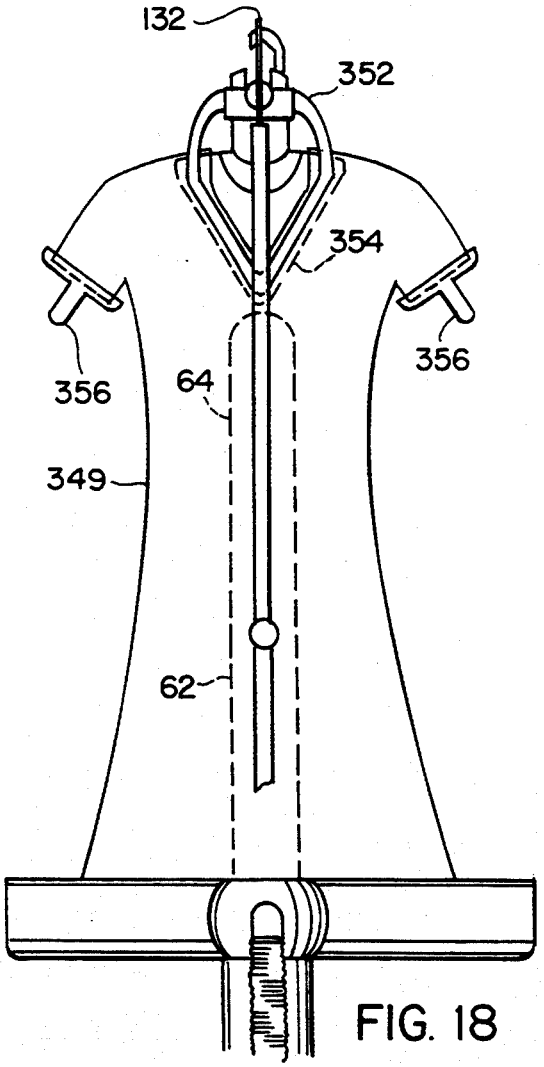
FIG. 18 is a fragmental back elevational view of the finishing machine, a dress is supported on the form and hangs from the garment support arm of the extendible pole wherein a lower portion of the dress is held in the gripper.
Figure 19:
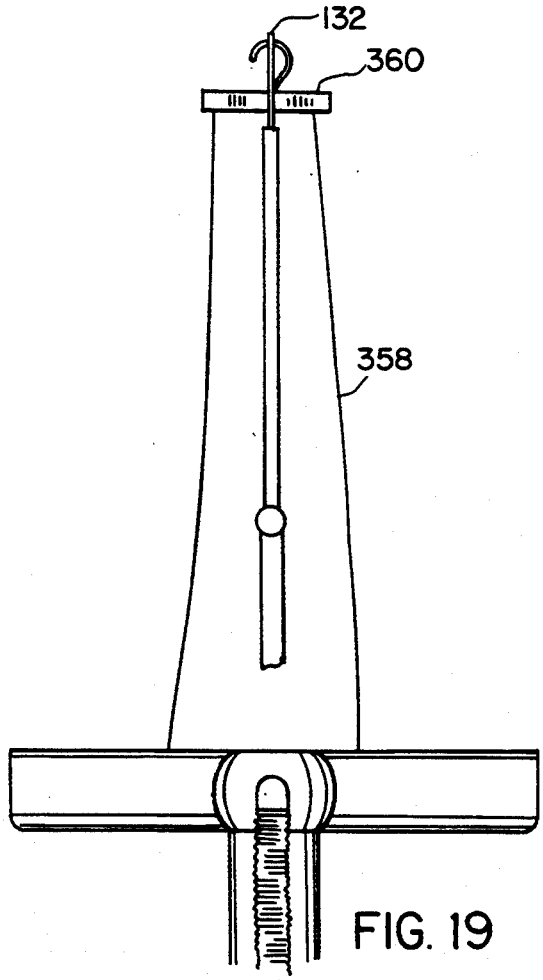
FIG. 19 is a fragmental back elevational view of the finishing machine, trousers hang upside-down from the garment support arm of the extendible pole wherein the waist portion of the trousers is held in the gripper.

Each clamp arm 104F, 104R (FIG. 10) in the gripping position, extends laterally away from the conduit for gripping an edge portion of a garment surrounding the conduit and spreading laterally between the arms (FIGS. 18 and 19). The arms close the edge portion upon itself in a wrinkle-reducing spread condition thereby facilitating treatment of the garment by fluid from the conduit.

As shown in FIG. 10, each clamp includes a central portion 108F, 108R, respectively, which is curved such that together the clamps surround the upper end portion of conduit section 60. Extending laterally from each end of each central portion is an intermediate portion 100F, 100R which connects to a clamp arm. An inner side of each intermediate portion opposes, in spaced relation, a corresponding inner side of the opposite clamp intermediate portion when the clamps are in the gripping position. The space defined by the opposed inner sides is tapered, narrowing in a lateral direction. Thus a gripper clamped garment can spread smoothly around the conduit and between opposing arms, avoiding impressions or creases in the fabric.

FIG. 11 shows that the arms and central portion of each clamp are hollow and in cross-section are C-shaped. Each clamp arm has a C-shaped cross-section similar to that of the clamp central portion. An inner concave surface 99 of each clamp faces toward a garment when gripped by the clamps wherein the concave surface is toward the opposing or opposite clamp.

The hollow arms and hollow central portion of each clamp are in fluid communication with each other. A distal end of each clamp arm is closed by an end wall 162F, 162R (FIG. 9).

As shown in FIGS. 1, the hollow gripper clamps are connected in fluid communication with conduit 32 through a flexible front tube 110. Upper and lower ends of tube 110 are connected to elbows 112, 114, respectively. Elbow 112 connects to the front clamp central portion 108F through an aperture in the clamp. Elbow 114 is connected to the conduit section 60 through an aperture positioned below the movable conduit sections. Hence, treating fluid can be blown into the clamps, including the clamp arms, by blower 33.

The rear clamp 103R is connected to an upper end of a rear tube 111 (FIGS. 1 and 9) in the same manner that the front clamp is connected to the upper end of front tube 110. Tube 111 has a lower end connected in fluid communication with a conventional control valve 796 (FIG. 1).

Valve 796 is a hollow box having a vent 798 which can be opened or closed. A short connector on a lateral side of the box connects the valve in communication with the inlet of blower 33.

When blower 33 operates, treating fluid travels up through tube 110 and is blown into the clamps. The fluid crosses from the arms of the front clamp into the arms of the rear clamp. The fluid is drawn from the clamps via tube 111 by negative pressure due to the intake of blower 33. Fluid from the clamps joins a larger flow of fluid entering the blower from vent 798.

The rapid flow of hot fluid through the clamps passes through a garment portion gripped between the clamps. The remainder of the garment is simultaneously treated by the larger fluid flow from the conduit and distributor.

As best seen in FIG. 11, each clamp includes a perforated vertical wall 106F, 106R, respectively, spanning between upper and lower edge portions of the clamp. Upper and lower edge portions of each perforated wall are bent to conform with clamp edge portions to support the wall. The perforated wall of each clamp runs along the entire length of the clamp and the wall is spaced from the inside surface 99 of the clamp. Thus, the perforated walls prevent gripper clamped garment portions from entering the hollow of the clamps. The perforated walls also help to distribute treating fluid over a gripper clamped garment portion.

The inside surface 99 of each clamp is coated with a reflective coating to reflect thermal energy toward the perforated wall and toward gripper clamped garment portions.

A soft rubber gasket or seal 101F, 101R (FIGS. 9–11) is cemented along all edges of each respective clamp, including the clamp central portion, intermediate portion, and arms. The seals conform to gripper clamped garment portions and inhibit the escape of treating fluid from between clamps.

A double-peaked core 105 (FIGS. 10 and 11), comprising a flexible fluid permeable fiber mesh, is cemented around conduit section 60 between the clamps. Each peak 59 (FIG. 10) extends laterally of the conduit. Each peak being positioned between and conforming to the opposed inner sides of the clamp intermediate portions when the clamps are in the gripping position.

Top and bottom surfaces of core 105 are defined by flexible rubber fluid barriers or walls 107 (FIG. 11) cemented to the top and bottom of the fiber mesh. Walls 107 inhibit escape of treating fluid from the top and bottom of the core and from the space between clamp intermediate portions. However, treating fluid within the gripper can easily flow horizontally through the core and through garment portions surrounding the core and conduit.

As shown in FIG. 1 and 12, the base 75 is a rectangular frame comprising four connected walls; a front wall 220 (FIG. 1), two side walls including side wall 222 (FIG. 12), and a back wall.

Pivotally mounted to the base is a foot bar 221 comprising a U-shaped bracket having two legs, each leg having an end portion pivotally attached to a respective side wall of the base by a fastener 224. The foot bar also includes a crossbar 226 (FIG. 1) spanning from one leg to the other. Connecting rods 158 (linkage to the gripper) have lower end portions pivotally connected to respective lugs 228 (FIG. 12) which extend from a back side of crossbar 226. Hence, when a user's foot presses down on the crossbar, the gripper clamps move to the open position for receiving a garment portion between the clamps.

A hollow pole holder 244, of square horizontal cross-section, is welded to an inside surface of the back wall of the base. Holder 244 receives pole 122 tightly therein. A screw 245 secures the pole and holder together.

An L-shaped foot lever 238 is mounted to pivot beneath the base. Lever 238 pivots on an axle 240 spanning through aligned apertures in the base side walls and through a short leg 241 of the foot lever. A foot pad 256 is attached to an outer end of the lever. The lever short leg includes a distal end attached to a flexible cord 252. The cord passes around the wheel of a pulley 253, mounted on holder 244. An upper end of the cord is operationally attached to conventional electric switches such as those indicated in FIGS. 23 and 27. A user can press on the foot pad to energize the electrical components of the system.

Mounted between the two side walls of the base is the heat blower 33 which is of conventional construction. A motor 229 (FIG. 1) drives the blower which moves air up through the blower nozzle 230 (FIG. 12). Conventional heat elements (not shown) are contained in nozzle 230 for heating blower driven air passing therethrough. Screws 232 fix the blower to the base.

An adapter flange 234 encircles the nozzle 230 and is tightly fitted into a lower end portion of conduit section 60 such that the blower nozzle and conduit are coaxially aligned.

A drain tube 236 passes through a small aperture through the adapter. Tube 236 will allow condensate, if any were to run down the inside of the conduit wall, to drain out. The drain tube may lead to a convenient receptacle (not shown) to store the condensate for eventual disposal.

Shown in FIG. 13–17 is a hollow garment form 330 for supporting a garment. A shoulder-shaped portion 334 is generally fluid pervious due to perforations 336.

Figure 16:
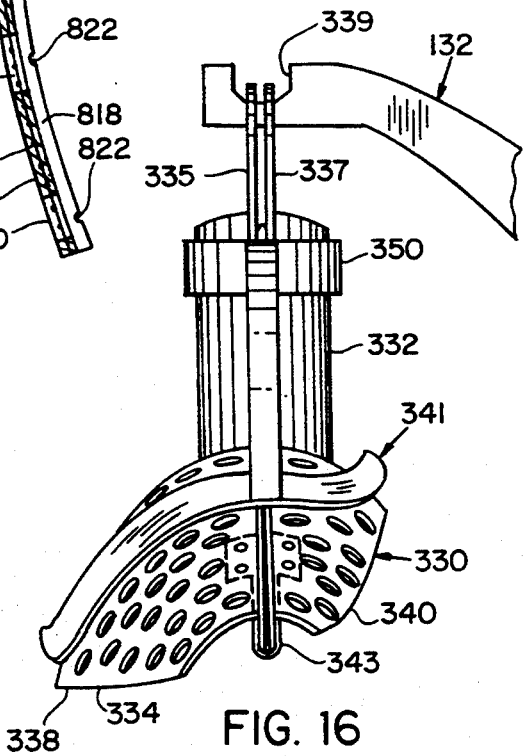
FIG. 16 is a side elevational view of the form closed over the hanger and hanging from the support arm wherein a form collar is mounted on the form.

The form is divided (see FIG. 13) into a front portion 338 and an adjacent back portion 340, each having respective front and back halves of a neck 332. Attached to an upper end portion of each neck half is a hook 335, 337 for hanging the garment form on support arm 132 (FIG. 16).

The shoulder-shaped portion defining an open bottom and open shoulder extremities so that the form can guide treating fluid into garment sleeves of a form supported garment. The open bottom of the form is positioned over the extendible conduit to allow the fluid emitting means proximity to garment sleeve entrances for increasing fluid flow into garment sleeves when the conduit is extended.

U-shaped resilient hinges 342, 343 (FIG. 17) connect the front and back portions so that the form is upwardly openable. Hinges 342, 343 are positioned below the opening for supporting an upright hanger 344 (FIG. 13) which may be inserted in the opening. The front and back form portions can be closed together over most of the hanger thereby inhibiting treating fluid, emitted into a form supported garment, from escaping through the opening. A U-shaped notch 345 (FIG. 17), in neck 332, allows easy removal of the hanger 344 from the form.

Figure 17:
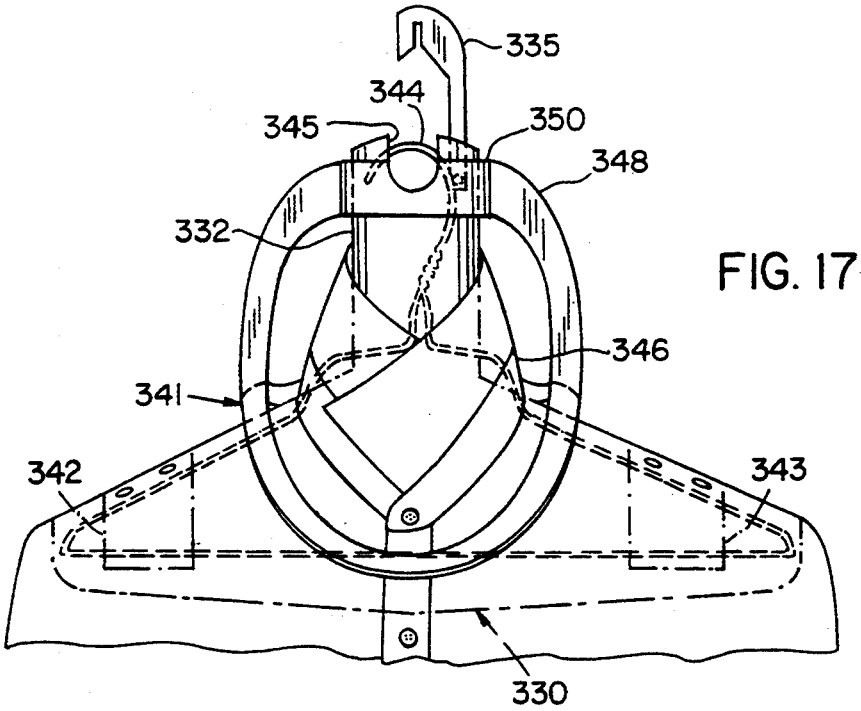
FIG. 17 is a front elevational view of the form containing the hanger and a shirt is dressed on the form wherein the form collar is mounted over the shirt.

A form collar 341, shaped to surround the neck 332 and conform to the shoulder-shaped form portion, is provided to rest on a garment dressed on the form. The form collar surrounds the garment collar 346 (FIG. 17). The form collar includes a handle 348 which is shaped like an upside-down U having a central ring 350. When the form collar is placed on a garment dressed on the form, the ring 350 surrounds neck 332 and holds the form collar in place. Ring grooves 341 (FIG. 13) around neck 332 increase holding friction between the neck and ring 350.

After a garment is treated, the form collar can be removed. Removing the hanger 344, from the form, separates the garment from the form and thereby hangs on the hanger.

Figure 14:
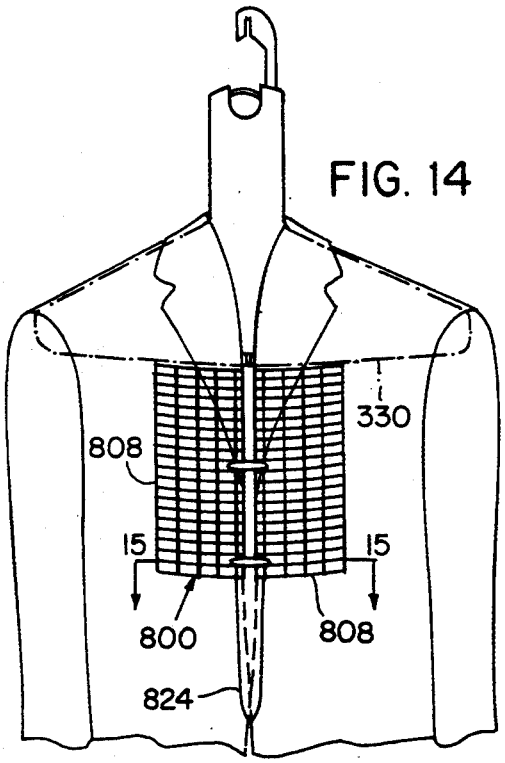
FIG. 14 is a front elevational view of the form and lapel clamp supporting a suit coat with coat lapels clamped in the lapel clamp.
Figure 13:
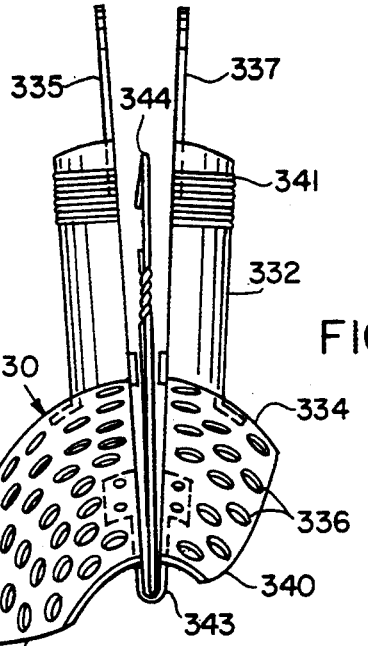
FIG. 13 is a side elevational view of a garment form opened to receive a conventional hanger, and connected to the form is a detachable lapel clamp opened to receive garment lapels or laps, the lapel clamp being shown in section taken along a vertical midline of an outer spine and an inner spine of the clamp.
Figure 15:
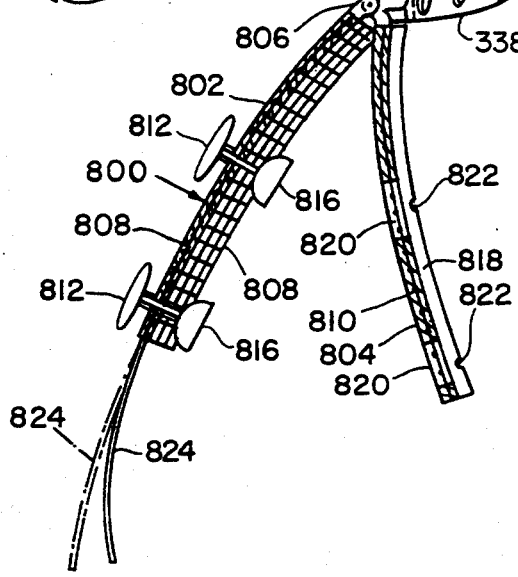
FIG. 15 is a sectional view taken along the line 15—15 of FIG. 14.
Figure 15:
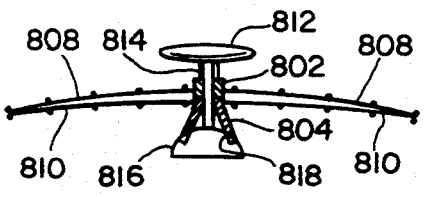

An accessory which can be detachably connected to the form is a lapel clamp 800 (FIGS. 13–15). The lapels or laps of garments that open at the front can be clamped without having to button the garment in order to be treated. The lapel clamp comprises an outer spine 802 and an inner spine 804, each having an upper end portion pivotally connected to form a hinge 806. A hook 801, extending from the top of the inner spine, passes through an aperture in the form to attach the lapel clamp. Both spines are molded plastic.

Embedded in the outer spine is a curved outer lap holder or outer grid 808 which extends symmetrically from both sides of the spine like a rib cage. The grid is constructed to be resilient and is comprised of spring wire coated with plastic. Similarly, embedded in the inner spine is an inner lap holder or inner grid 810 extending symmetrically from both sides of the spine. Both grids 808, 810 are of similar size and construction except that grid 810 is less curved in lateral directions. As result, lateral portions of the outer grid compress against those of the inner grid when both spines are closed together.

Means for holding the inner and outer spines when closed together comprise latches having elongated handles 812. Fixed to each handle is a respective shaft 814 (FIG. 15) which passes through a respective aperture in spine 802. A distal end of each shaft is fixedly connected to a respective cam 816 which is shaped like half of a disk. The thickness of each cam is about the same as the diameter of a shaft. Each handle is parallel with its corresponding cam.

A back side of spine 804 includes a channel 818 having a V-shaped groove along the length of the spine. Longitudinal slots 820 (FIG. 13), passing through spine 804, allow the cams to pass through the inner spine and into the channel when the outer spine is closed against the inner spine. The cams must be in a vertical position in order to pass through the inner spine.

When the handles, and therefore the cams, are rotated ninety degrees to a horizontal position, the channel acts as a cam follower thereby resulting in both spines being forced tightly together. Notches 822 releasably hold respective cams in the horizontal position. Thus, the inner and outer grids are compressed together to hold each lap or lapel of a garment between corresponding lateral sides of the grids (FIG. 14). As indicated in FIG. 15, opposing grid portions closest to the spines are slightly spaced when the clamp is closed to avoid leaving impressions in the lapels of lady's or men's suit coats.

A resilient polypropylene tail piece 824 (FIG. 13) extends from the lower end of the outer spine. The tail piece is slightly concave on its back side and curves increasingly backward with decreasing distance from its distal end. The tail piece covers edges, of a fluid inflated garment, which may abut or slightly overlap below the spines during treatment.

Shown in FIG. 18 is an accessory V-shaped form collar 352 provided for accommodating dresses having a V-shaped neckline. An accessory fluid impervious V-shaped dickey 354, for low-necked dresses, is draped on the form under the dress neck opening to inhibit escape of treating fluid therefrom.

An accessory U-shaped impervious dickey (not shown) may also be provided for inhibiting escape of treating fluid from low-neckline garments having U-shaped neck openings. The form and accessory items may be provided as a kit.

Modifications

Figure 21:
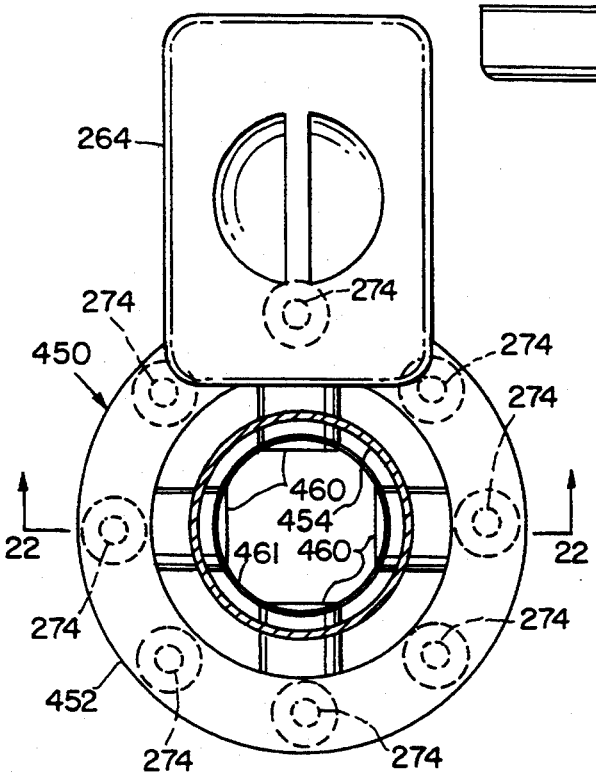
FIG. 21 is a top view, partly in section, of a modified ultrasonic humidifier mounted in fluid communication with a heat blower nozzle of a finishing machine embodiment.
Figure 22:
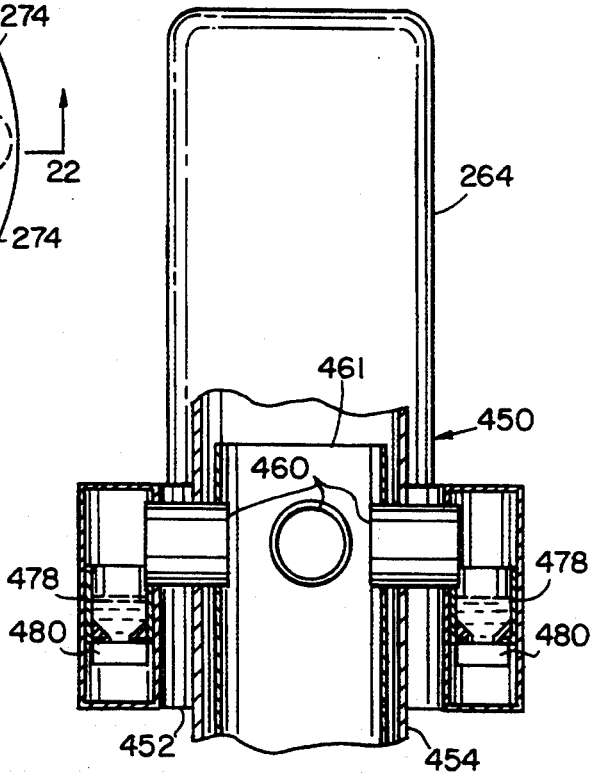
FIG. 22 is a fragmental view in elevation, partly in section taken vertically along the line 22—22 of FIG. 21, heat elements of the heat blower nozzle being removed.

Shown in FIG. 21 and 22 is an ultrasonic humidifier 450 which can be mounted to the finishing machine conduit for moisturizing treating fluid.

Humidifier 450, including its water tank 264, is conventional in construction except for the details described hereinafter. The mist chamber, defined by a housing 452, extends around the finishing machine conduit 454. A reservoir 478 contained therein, also surrounds the conduit for holding an endless ring of water. The extended mist chamber housing 452 resembles a ring-shaped cake mold surrounding the conduit. Eight conventional mist producing transducer/nebulizer combinations 274 surround the conduit and are in mist-producing relationship with the reservoir to generate mist. The transducer/nebulizer combinations are each contained in a respective conventional chassis 480. Electrical components for operating the transducers are also conventional and therefore not shown.

Four nozzles 460 pass out of the mist chamber and through apertures in the conduit and heat blower nozzle 461 to connect the chamber in fluid communication with the finishing machine heat blower. The conduit 454 is otherwise the same as conduit 32 and nozzle 461 is otherwise the same as heat blower nozzle 230.

In a machine having humidifier 450, shaft 80 (FIG. 12) could be made longer and repositioned parallel to sleeve 78 in order to operate between the conduit and the ring-shaped mist chamber. Otherwise, shaft 80 could be removed wherein the rod 70 for extending the conduit could be operated by the cord and pulley system described hereinbefore.

Figure 23:
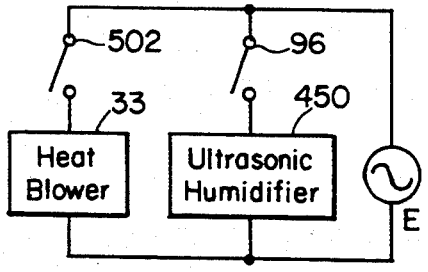
FIG. 23 is an example of a circuit showing how components of a finishing machine embodiment, which includes the ultrasonic humidifier, may be electrically connected.

Shown in FIG. 23 is a circuit arrangement which includes the ultrasonic humidifier 450. In this arrangement, switches 502 and 96 can operate the heat blower and humidifier, respectively.

Figure 24:
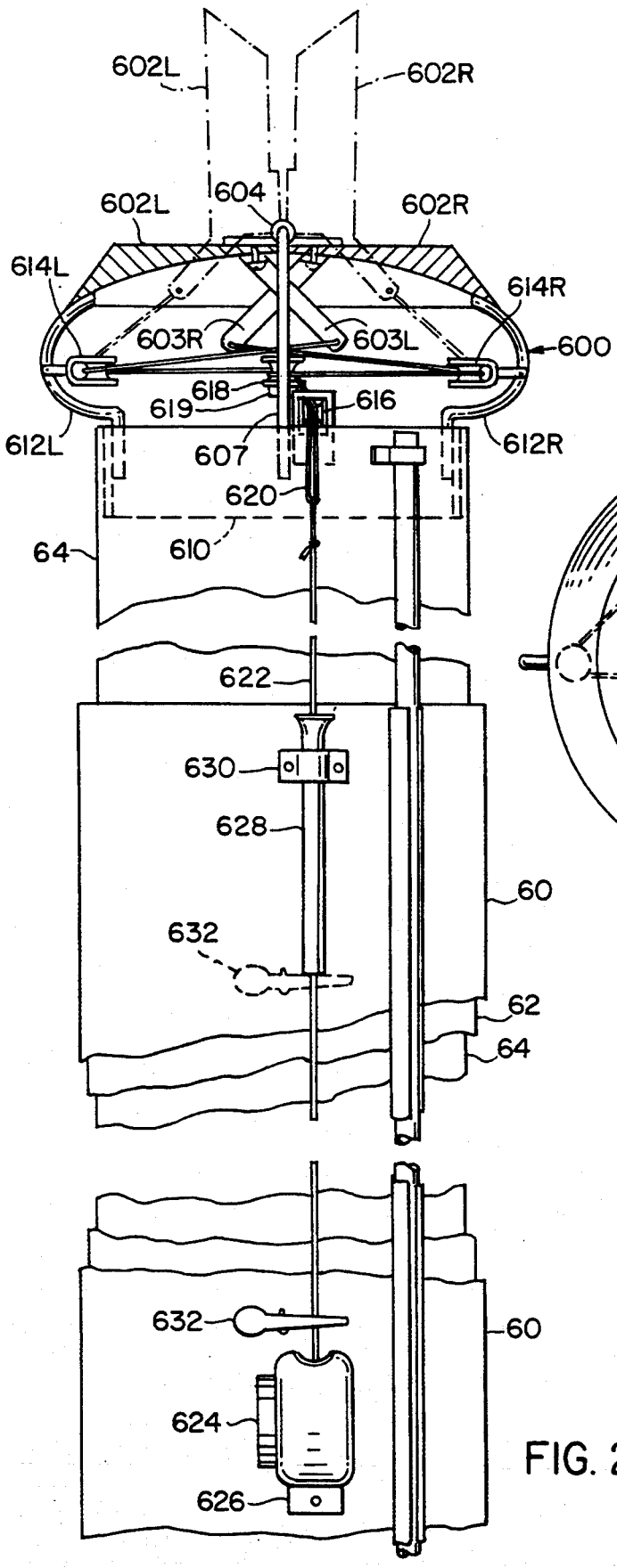
FIG. 24 is a sectional view taken along a vertical axis of an alternative fluid distributor having movable fluid guides, the distributor is shown inserted into an extendible conduit of a finishing machine embodiment, components for moving the guides being attached to the front of the conduit.
Figure 25:
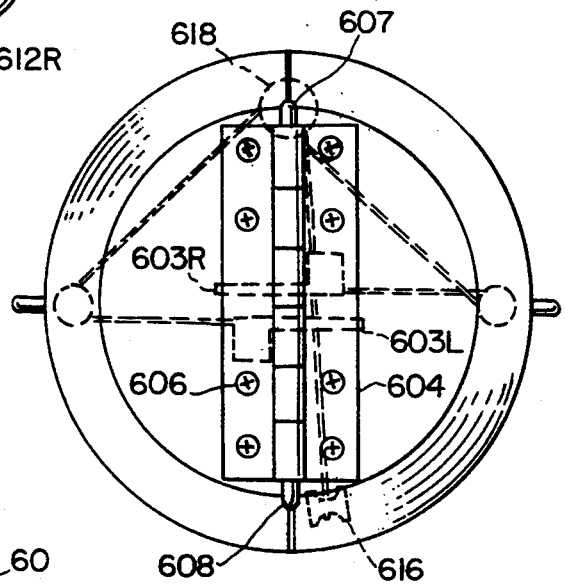
FIG. 25 is a top view of the fluid distributor of FIG. 24.

Shown in FIGS. 24, 25, is another fluid distributor 600 inserted into conduit section 64 in place of those described hereinbefore. Distributor 600 includes a pair of semicircular fluid guides 602L, 602R positioned on opposite sides, respectively, of the conduit longitudinal axis. When resting horizontally together, the two guides form a round upside-down bowl having a flat top side and a concave underside.

Each guide is fixed to each leaf, respectively, of a hinge 604 with screws 606. The guides and hinge are pivotally supported on a wire bracket 607 shaped like an upside-down U. The two vertical legs of bracket 607 are welded to diametrically opposite inner sides, respectively, of an annular collar 610. The collar is tightly inserted into an upper end portion of conduit section 64. A horizontal portion of bracket 607 passes through the hinge like a hinge pin and serves as an axle 608, about which the hinge and guides can pivot. Thus, both guides are movable relative to each other and pivot on a common axis which is transverse to the conduit axis.

A lever 603L, 603R is fixed to the underside of each guide, respectively, with a screw. Each lever is positioned near the center of the "bowl" under the hinge and is angled at about forty five degrees to the conduit axis when the guides are horizontal. The levers are transverse to each other and spaced slightly apart so that they do not interfere with each other as the guides pivot. A small bore in a distal end portion of each lever is provided for attachment of monofilament described hereinafter.

The concave undersurface of each guide conforms to and rests on an upper end portion of a curved wire support 612L, 612R, respectively. A lower vertical portion of each support is welded to diametrically opposite inner sides, respectively, of collar 610. Each support is ninety degrees (around the collar) from bracket 607.

A system of four conventional pulleys is provided for pivoting the guides. They include a first pulley wheel 616 rotatably supported on a frame welded to the inner side of collar 610 and juxtaposed to one leg of bracket 607. The rotational axis of pulley wheel 616 being horizontal. A second pulley wheel 618 rotates about the opposite leg of bracket 607 on top of a fixed flange 619 which encircles the leg. The rotational axis of pulley wheel 618 being vertical. Two swivel mounted pulleys 614L, 614R are pivotally attached to each respective support.

The pulley system is operatively connected by a monofilament circuit beginning outside of the distributor as two strands joined at their outer ends to form a loop 620. The two strands engage pulley wheel 616 and together the strands span over to engage the diametrically opposite pulley wheel 618. After partial encirclement of wheel 618 the two strands separate. One strand spans over to engage pulley 614L and then spans over to connect to the distal end of lever 603L. The other strand spans over to engage pulley 614R and then spans over to connect to the distal end of lever 603R.

As arranged, a downward pull on loop 620 will cause symmetrical pivotal movement of the guides to move from the horizontal position to a vertical position (indicated by the phantom image in FIG. 24). The heavy weight of guides urges them toward the horizontal position.

Connected to loop 620 is the upper end of a cord 622 which extends vertically downward to connect at its lower end to the reel of a conventional spring driven cord retractor 624. The retractor includes a mounting shoe 626 riveted to the outside wall of conduit section 60. A weak spring (not shown) within the retractor urges a reel (not shown) within the retractor to wind the cord. Hence, the cord and monofilament are under slight tension from the spring. A strong downward pull on the cord can pivot the guides to the vertical position. However, the heavy guides do not pivot from their horizontal position merely from the tension of the spring on the cord and/or upward fluid pressure from the blower.

A flexible tube 628, having a least one end flared, surrounds the cord and is attached to an upper end portion of conduit section 60. A small pipe retainer 630, riveted to the conduit, provides the means for attachment. The cord slides freely up and down through the tube when the gripper clamps close to hold a garment around the conduit. Hence, tube 628 shields cord 622 so that the distributor 600 and the cord can move up and down within the garment.

A conventional clip 632 can be attached at selectable positions along the cord. The clip stops upward movement of the cord when the clip contacts tube 628 (phantom image in FIG. 24). Thus, the guides will pivot by further extending the conduit. Pivotal movement of the guides can therefore be slaved to extending or contracting the conduit.

The guides cause fluid emitting from the conduit to diverge at angles that vary as the guides pivot. When in the horizontal position the guides direct treating fluid, from the conduit, laterally and downward to treat a lower portion of a garment surrounding the distributor. As the distributor is moved upward within a shirt or blouse by the extending conduit, upper portions of the garment are treated. When the clip 632 reaches tube 628, the stopped cord causes the guides to begin pivoting toward their vertical positions. As they pivot, the concave surfaces of the angled guides focus the treating fluid into the sleeves and shoulders of the garment.

The clip can be selectively positioned so that the guides will automatically pivot to an appropriate angle within a garment in cooperation with the height of the distributor. The cord can be marked at graduated intervals, related to the size of the garment, for precise positioning of the clip. The guides can also be pivotally moved to preferred angles by hand control of cord 622.

Operation of the Finishing Machine

If preferred, collars and cuffs can be spread within the gripper and treated therein.

After inserting a conventional hanger 344 into form 330 (FIGS. 13–17), garments normally worn above the waist, such as a dress, shirt, blouse, or coat may be dressed on the form. Shirt, blouse, or suit coat laps can be inserted in the lapel clamp 800. The form may then be hung on the garment support arm 132 as shown in FIG. 16. Sleeve openings may be closed off with conventional clips 356 (FIG. 18).

The height of pole 122 (FIG. 6) can be adjusted, by knobs 130, so that a lower edge portion of the garment hangs within gripping range of the gripper clamps. By stepping on crossbar 226 (FIG. 1, 12), the gripper will open. The user can use both hands to spread the lower edge of the garment to surround the distributor and extend between the clamp arms. Release of the crossbar closes the clamps on the garment.

Stepping on pedal 256 (FIG. 12) sends hot treating fluid through the distributor and into the garment. Simultaneously, the gripper clamped portion of the garment is treated by fluid within the clamps. By moving handle 84 up and down, the fluid emitting distributor vertically traverses the interior of the garment.

As shown in FIG. 19, trousers are treated by hanging them upside-down from arm 132 using a trouser hanger 360 to close off the leg openings. The waist is held in the gripper and the user guides the distributor into each trouser leg to traverse up and down therein.

The waist of the skirt is first closed off with a skirt hanger (not shown), such as that of U.S. Pat. No. 3,603,491 issued to Weight. After hanging the skirt on support arm 132 with the skirt hanger, treatment may proceed in the same manner as applied to the dress of FIG. 18.

Automating the Finishing Machine

It is possible to automate the machine such that even less attention by a user would be required. Though a fully automated system is not shown, the conduit could be extended and contracted with a servomotor by rack and pinion or by a telescoping hydraulic lifter. The height to which the conduit extends can be controlled from an electronically stored set of programs; one program for each type of garment. Another control method is by feedback from a sensor that detects when the fluid distributor reaches the top of a garment. A servomechanism could control cord 622 (FIG. 24), thereby controlling fluid guides 602, according to the height to which the conduit must be extended within each type of garment being treated.

Connecting The Finishing Machine With A Clothes Dryer

A conventional clothes dryer moves air mostly around garments rather than through them. Garments in a dryer must, therefore, undergo a long period of continuous tumbling at relatively high temperatures.

A greatly improved clothes drying system can be achieved by combining a conventional electric dryer with the finishing machine. Hot exhaust air from the dryer is not saturated and can be efficiently used by the finishing machine connected to the dryer exhaust outlet. In that arrangement, towels, bed sheets, socks, and underwear can be dried in the dryer while outer clothing can be more advantageously dried by the finishing machine.

The finishing machine forces air through the distended fabric of a garment. The device can therefore dry a wet garment wrinkle-free more efficiently and at lower temperatures than a conventional clothes dryer. Unlike a conventional dryer, clothes dried on the finishing machine are not worn out by the lint-producing friction of tumbling, are less likely to shrink, and are wrinkle-free. The machine also uses less energy.

Figure 26:
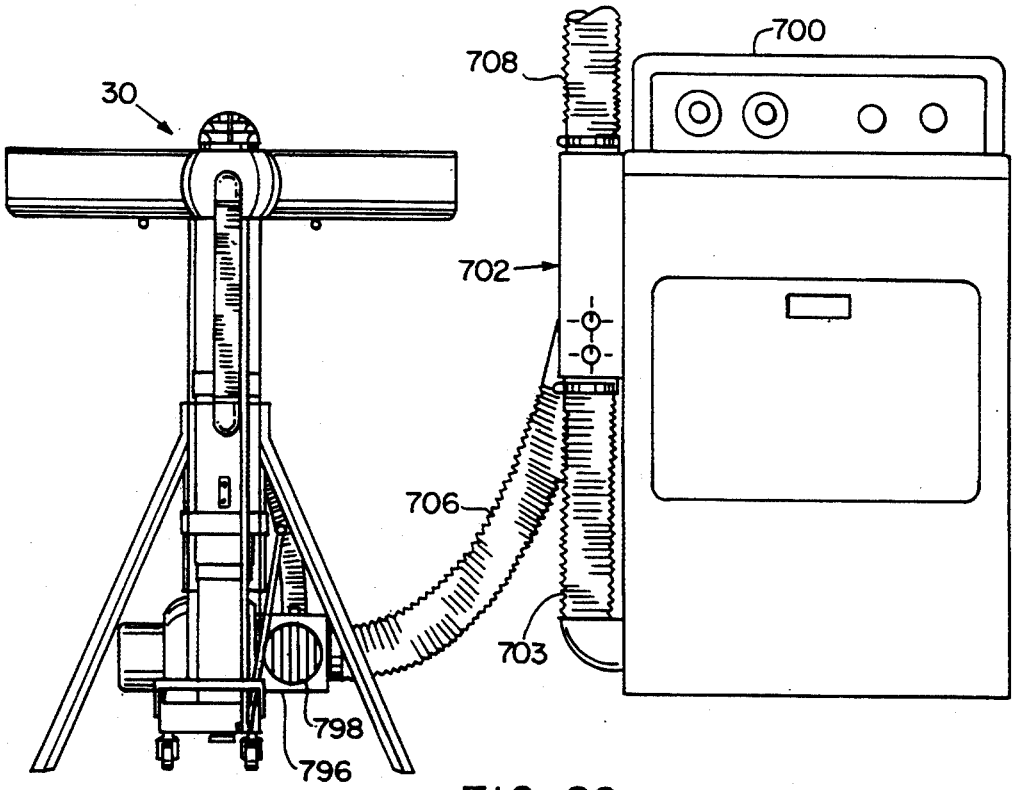
FIG. 26 is a front elevational view if the finishing machine of FIG. 1 duct connected to a diverter (side view) which is mounted on and duct connected to an electric clothes dryer.
Figure 27:
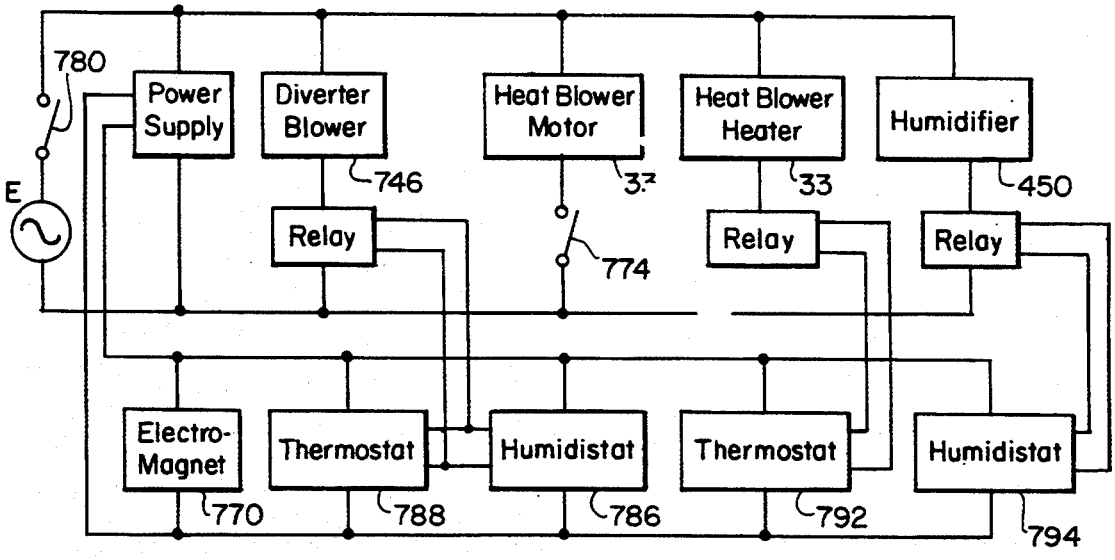
FIG. 27 is circuit diagram showing how the system of FIG. 26 may be electrically connected.

FIGS. 26 and 27 show a system in which the finishing machine 30 is connected with a conventional electric clothes dryer 700. Hot moist air exhausted from the clothes dryer, through duct 703, first passes through a diverter 702 mounted on the side of the dryer. If the dryer and finishing machine are both operating, the diverter directs the dryer exhaust to the finishing machine via duct 706. The duct 706 connects to valve 796 by a connector on a lateral side of the valve so that the duct is in fluid communication with the blower of the finishing machine.

By adjusting vent 798, a selectable proportion of dryer exhaust and ambient air can be drawn into machine 30.

The diverter includes a feedback system that maintains a proper level of heat and humidity in the laundry area. In summer, while the finishing machine and dryer are operating, a blower in the diverter moves ambient air from the laundry area to the outside of the home via duct 708. Hence, exhaust air from the finishing machine is sent to the outside of the home. If the finishing machine is not in use, the diverter directs the dryer exhaust to the outside of the home via duct 708.

Figure 29:
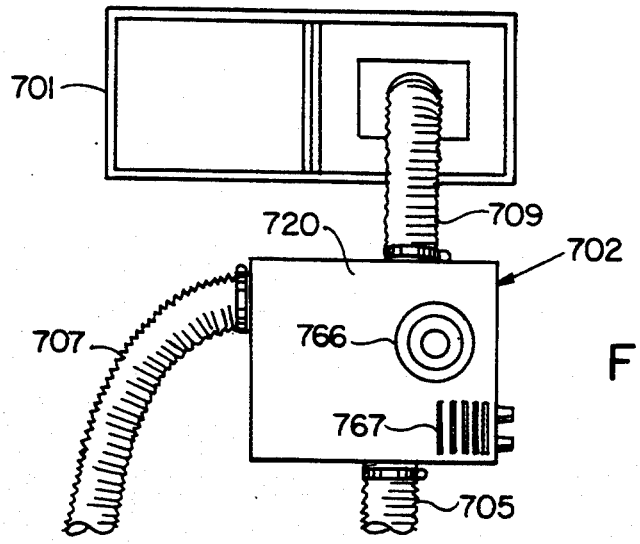
FIG. 29 is the diverter of FIG. 28 in an alternative installation which includes its front cover and ducts attached.

FIG. 29 shows an alternative installation where the diverter 702 is mounted on a wall below a window 701 used for venting.

Figure 28:
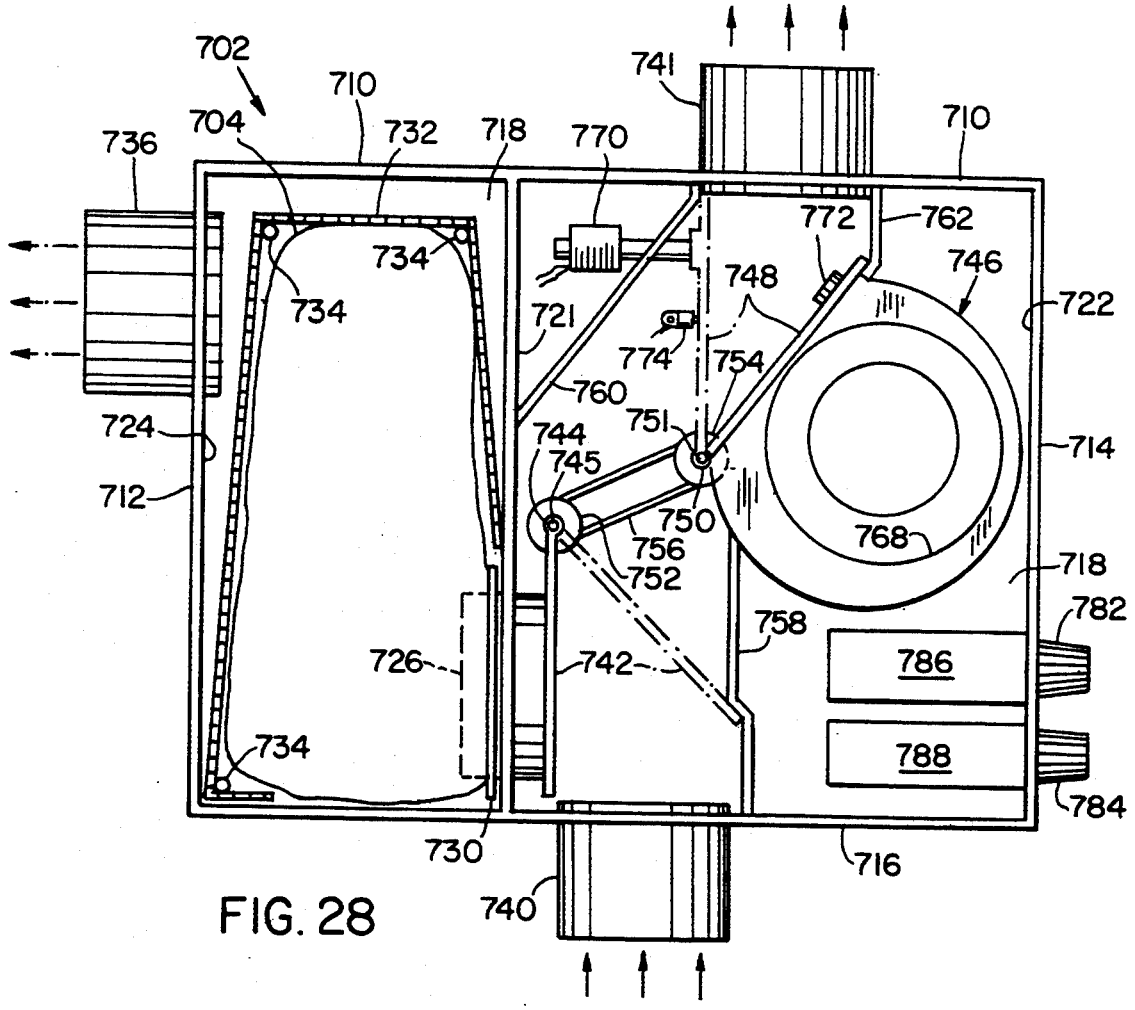
FIG. 28 is a front elevational view of the diverter of FIG. 26 unmounted and without its front cover and without ducts attached.

As shown in detail in FIG. 28, the diverter comprises a rectangular box having side walls 710, 712, 714, 716, and a back wall 718. A partition 721 divides the box into a right chamber 722 and a left chamber 724.

Leading into the right chamber is a first duct connector 740 comprising a short tube fixed in an aperture through wall 716. Connector 740 serves for connecting the diverter to the exhaust outlet of the dryer via duct 703 (FIG. 26).

A second duct connector 741 (FIG. 28) comprises a short tube fixed in an aperture through wall 710. Connector 741 serves for connecting the diverter to the exhaust duct 708 (FIG. 26) which vents to the outside of the home.

FIG. 29 shows the front cover 720 of the diverter. When the cover is on the box, the only air passage from the right chamber to the left chamber is through a short nipple 726 (FIG. 28) having a four inch inside diameter. The nipple is fixed in an aperture through partition 721.

When the finishing machine is not operating, a first gate 742, in a gate down position, blocks nipple 726. Gate 742 is a rectangular plate having a hinge 744 which pivots about a hinge pin 745. Pin 745 has an end fixedly attached to wall 718.

Similar to the first gate is a second gate 748 which, in a gate down position, blocks the outlet of a blower 746. The second gate is a rectangular plate having a hinge 750 which pivots about a hinge pin 751. Pin 751 has an end fixedly attached to wall 718.

Each gate is fixed to a pulley 752 and 754, respectively, which pivots about a respective gate hinge pin. The two pulleys are operatively connected by a belt 756 so that each gate is slaved to the other. Both gates move together between their respective gate down positions and gate up positions. The gate up positions are indicated by the phantom images. The weight of the gates urge them toward their respective gate down positions.

Gate 742, in the gate up position, contacts a guide wall 758. Gate 748, in the gate up position, contacts a guide wall 760 and in the gate down position contacts a guide wall 762. The three guide walls 758, 760, 762, like the gates, span between the back wall 718 and cover 720 of the diverter 702. Together the guide walls guide exhaust air from duct connector 740 to duct connector 741 when the gates are in their gate down positions.

That is, when the finishing machine and blower 746 are not operating, exhaust air from the dryer (indicated by solid arrows) is guided through the diverter to the outside of the home.

As explained hereinafter, the gates are up when the finishing machine is in use. Dryer exhaust is then diverted by gate 742 through a disposable lint filter bag 704 made of woven nylon. A single entrance into the bag is at its cardboard collar 730 which fits tightly around nipple 726.

Surrounding the filter bag is a perforated cage 732 held in place by posts 734 fixedly attached to back wall 718. The walls of the cage span between back wall 718 and cover 720. The cage serves to contain the bag and maintain a space between the bag and the walls of the left chamber. Hence, air from nipple 726 passes through the fabric of the bag and then passes out of the left chamber through a third duct connector 736. From connector 736, the hot exhaust air is guided through the duct 706 (FIG. 26) leading to the finishing machine.

The disposable filter bag 704 (FIG. 28) can be replaced by first removing the diverter cover and pulling cage 732 off of posts 734. The filter bag can then be replaced like a disposable vacuum cleaner bag.

The system is electrically connected as shown in the circuit diagram of FIG. 27. Closing switch 780 actuates operation of the system. The gates are moved to their respective gate up positions by the force of air from the outlet of blower 746. Electromagnet 770 draws and holds an iron disk 772 which is fixed to gate 748. The magnet holds the gates in their gate up positions. In the gate up position, gate 748 switches on a momentary switch 774 which starts the heat blower motor of the finishing machine.

The temperature and/or humidity of air emitted by the finishing machine may be increased if necessary by contributions from the heat blower 33 and humidifier 450 of the finishing machine. The level of the contributions can be automatically controlled by a conventional thermostat 792 (FIG. 27) and humidistat 794 which may be housed in the air inlet of the machine. The machine's ultrasonic humidifier 450 may be turned on, for example, when the dryer is off and dry clothes are to be unwrinkled by the finishing machine.

As indicated in FIGS. 27 and 28, another conventional humidistat 786 and conventional thermostat 788 monitor ambient air in the laundry area. If the ambient air temperature or humidity drops below levels selectable by knobs 782, 784 (FIG. 28), blower 746 is automatically turned off. Therefore, blower 746 operates mostly in summer to send air exhausted by the finishing machine to the outside of the home. Openings 767 (FIG. 29), in diverter cover 720, allow the humidistat and thermostat to monitor the ambient air. Cover opening 766 allows ambient air to be drawn into the blower intake vent 768 (FIG. 28) when the blower is turned on.

When the finishing machine is operated without dryer 700, vent 798 (FIGS. 1 and 26) may be fully opened to draw ambient air into the machine.

As mentioned, FIG. 29 shows an installation where the diverter 702 is mounted on a wall below a window 701 used for venting. In this case, duct 705 is connected to the outlet of the dryer. Duct 707 is connected to the finishing machine inlet and duct 709 vents to the outside of the home.

While the above description contains many specificities, these should not be construed as limitations on the scope of the invention, but rather as exemplifications of preferred embodiments thereof. Those skilled in the art will envision other possible variations that are within its scope. Accordingly, the scope of the invention should be determined not by the embodiments illustrated, but by the appended claims and their legal equivalents.

What is claimed is:

1. A garment finishing machine comprising:
an ultrasonic humidifier for generating mist;
heat means, connected to the humidifier, for heating and vaporizing the mist; and
means for moving and guiding the vapor to treat a garment.

2. The finishing machine as defined in claim 1, wherein the means for moving and guiding the vapor includes a telescopically extendible conduit for guiding the vapor.

3. The finishing machine as defined in claim 1, further comprising a sleeve distributor connectable to a conducting means, the distributor being in the shape of a hollow frustum of a cone having an open base and an open top portion so that fluid from the conducting means can pass in through the base and out through a top portion for treatment of sleeves and other narrow garment portions, the distributor having a deflector positioned adjacent the top portion for deflecting some of the fluid to flow over the distributor exterior thereby treating surrounding narrow garment portions.

4. A garment finishing machine comprising:
conducting means for conducting garment treating fluid;
emitting means for emitting the conducted fluid to treat a garment;
a gripper having two opposed clamps movably supported for movement toward and away from each other between a garment gripping position and an open position, each clamp being hollow and having an opening leading toward the opposite clamp such that the clamps are in fluid communication with each other when in the gripping position;
positive pressure means for introducing garment treating fluid under positive pressure into one clamp; and
negative pressure means for drawing fluid from the clamp opposite the positive pressured clamp thereby compelling fluid to pass through a gripper clamped garment portion between the clamps.

5. The finishing machine as defined in claim 4, further comprising a concave reflecting surface within at least one clamp for reflecting radiant thermal energy toward a gripper clamped garment.

6. A garment finishing machine comprising:
an imperforate tubular conduit telescopically arranged in overlapping sections in order to be longitudinally extendible;
connecting means for connecting a source of garment treating fluid under pressure in fluid communication with the conduit; and
fluid emitting means for emitting the fluid from the conduit at inside-garment locations reached by telescopically extending the conduit.

7. The finishing machine as defined in claim 6, wherein the fluid emitting means comprises:
a general distributor including a first guide having an axis and a funnel-shaped outer surface substantially surrounding the axis and extending laterally of the axis for diverting fluid laterally thereof; and
an inner fluid guiding surface surrounding the axis and being in spaced relation to the first guide surface, one of the surfaces defining an approximately elliptical configuration and the other surface defining an approximately circular configuration.

8. The finishing machine as defined in claim 6, wherein the fluid emitting means comprises a distributor having an axis and a wall substantially surrounding the axis in spaced relation, the wall having openings distributed around the axis for emitting fluid laterally thereof, the openings being on opposite sides of a dividing plane in which the axis lies, generally each of the openings being greater in area relative to the area of an adjacent opening which is closer to the plane.

9. The finishing machine as defined in claim 6, wherein the fluid emitting means comprises a distributor having an axis and a wall substantially surrounding the axis in spaced relation, the wall having openings distributed around the axis for emitting fluid laterally thereof, the openings being on opposite sides of a dividing plane in which the axis lies, generally each area of the wall between two openings being smaller relative to an adjacent area of the wall between two openings which adjacent area is closer to the plane.

10. The finishing machine as defined in claim 6, further comprising a cord retractor connected to a first section of the conduit, the retractor including a retractable cord having an end portion connected to another section of the conduit which is telescopically movable relative to the first conduit section, the retractor having drive means for drivingly retracting the cord as the conduit telescopically retracts.

11. The finishing machine as defined in claim 6, further comprising a hollow garment support form including a shoulder-shaped fluid permeable portion defining open shoulder extremities so that the form can guide treating fluid into garment sleeves of a form supported garment, the form being positioned over the telescopically extendible conduit such that the same can extend vertically within the form.

12. The finishing machine as defined in claim 11, further comprising:

the shoulder-shaped portion being divided into adjacent front and back portions; and hinge means for pivotally connecting the front and back portions so that the form is upwardly openable for receiving an upright garment hanger such that said front and back portions can be closed together over the hanger wherein removing the hanger from the form separates the garment from the form thereby hanging the garment on the hanger.

13. The finishing machine as defined in claim 11, further comprising a dickey for being combined with the form under the garment to inhibit escape of treating fluid through the garment neck opening.

14. The finishing machine as defined in claim 11, further comprising a clamp for clamping garment lap portions, the clamp comprising:

an inner spine connectable to the form and having garment lap holding means extending laterally therefrom for holding garment laps; and an outer spine substantially aligned and pivotally connected to the inner spine for moving the outer spine toward and away from the inner spine between a closed position and an open position, the outer spine having garment lap holding means extending laterally therefrom for holding garment laps between the lap holding means of each spine when the outer spine is in the closed position.

15. A garment finishing machine comprising:

fluid conducting means for conducting garment treating fluid, the conducting means having an end portion for releasing the fluid;

a pair of fluid guides juxtaposed and connected to the end portion of the conducting means, each guide being pivotally supported and movable relative to the other guide such that the guides move together like a pair of butterfly wings to deflect fluid, emitting from the conducting means, to diverge at angles that vary as the guides pivot; and guide control means for controlling the pivotal movement of the guides within garments.

16. The finishing machine as defined in claim 15, wherein the guides together have a concave underside and form the shape of an upside-down bowl.

17. The finishing machine as defined in claim 15, wherein the guides have imperforate surfaces.

18. The finishing machine as defined in claim 15, wherein the guides pivot on a common axis.

19. The finishing machine as defined in claim 15, further comprising the fluid conducting means being a telescopically extendible conduit connected in slave relationship with the guides such that the guides pivot by extending the conduit.

* * * * *